United States Patent [19]

Bresee et al.

[11] Patent Number: 4,619,664

[45] Date of Patent: Oct. 28, 1986

[54] METHOD OF IMPROVING THE ABRASION RESISTANCE OF RECYCLED WOOL

[75] Inventors: Randall R. Bresee, St. George; Barbara M. Reagan, Manhattan, both of Kans.

[73] Assignee: Kansas State University Research Foundation, Manhattan, Kans.

[21] Appl. No.: 707,890

[22] Filed: Mar. 4, 1985

[51] Int. Cl.[4] ..... D06M 3/02; D06M 13/00

[52] U.S. Cl. ..... 8/128 A; 8/128 R; 8/115.62

[58] Field of Search ..... 8/128 R, 128 A, 115.62

[56] References Cited

U.S. PATENT DOCUMENTS 2,406,412 8/1946 Speakman et al. ..... 8/128 A

OTHER PUBLICATIONS

Varma et al., Die Angewandte Makromolekular Chemie, vol. 35, 203–211, (1974).

*Primary Examiner*—Paul Lieberman
*Assistant Examiner*—John F. McNally

[57] ABSTRACT

The abrasion resistance of fabric composed partly or wholly of recycled wool fibers (reprocessed or reused wool) is increased by impregnating the fabric with an aqueous solution of an acrylate monomer containing a polymerization initiator, an acid, and, preferably, a surfactant promoting contact of the fibers with the solution. The fabric, which has been impregnated at a temperature below the polymerization initiation temperature, is washed with water to remove the impregnating solution from the exterior scaly surface of the wool fibers while leaving the solution within the fiber cortex, and thereafter the fabric is cured by heating it at a temperature above the polymerization initiation temperature of the acrylate monomer. The process provides a means for increasing the durability of the fabric without appreciable modification of other desirable properties of the fabric.

9 Claims, 2 Drawing Figures

METHOD OF IMPROVING THE ABRASION RESISTANCE OF RECYCLED WOOL

BACKGROUND AND PRIOR ART

The field of this invention relates to methods for improving the abrasion resistance and durability of fabric containing a substantial amount of recycled wool fiber.

According to accepted usage in the wool processing industry, the term "recycled wool" covers both reprocessed wool (viz. cutting scraps) and reused wool (viz. shredded clothing). Such recycled wool fibers are shorter than those of virgin wool and more difficult to form into yarn. However, techniques are known for spinning recycled wool fibers to form yarn, which can be used to weave fabric, which may be composed partly or wholly of the recycled wool having less abrasion resistance and less durability than cloth formed from virgin wool. Consequently, a need has been recognized to provide a relatively simple and inexpensive process for improving these properties of such fabric without at the same time appreciably downgrading the other desirable properties of the fabric.

It is known that wool fibers can be reacted with a variety of monomers such as the various acrylate monomers to introduce these compounds onto wool by reactions such as acylation or free radical graft polymerization. Illustrative of the art are Miller, et al., *Textile Res. J.* Vol. 31, 451–455 (1961); Varma, et al., *Die Angewandte Makromolekular Chemie,* Vol. 35, 203–211 (1974); and Arai, et al., *Int. J. Macromol.,* Vol. 2, 355–360 (1980). No such reference is known which relates to the treatment of recycled wool fibers or cloth prepared from such fibers with vinyl monomers.

SUMMARY OF INVENTION

The method of this invention provides a means to increase the abrasion resistance of fabric composed partly or wholly of recycled wool fibers. This can be accomplished without producing other undesirable changes in the wool fiber properties, at least to the extent that such changes materially affect the quality of the treated wool fabric.

This invention takes advantage of the fact that the outer scaly armor of wool fibers (the cuticle) is characterized by chemical inertness, while the interior protein of the fiber (the cortex), when exposed, is much more highly reactive. In particular, the keratinous protein of the fiber interiors provides free hydroxyl and amino groups which are available for chemical reaction.

The method of this invention also takes advantage of the fact that recycled wool fibers contain breaks or fissures in the scaly cuticle which, in effect, expose interior protein. It is these breaks or fissures which, in part, cause the reduced abrasion resistance and durability of fabric prepared from recycled wool fibers. With virgin wool the cuticle on the fibers is much more intact.

According to the method of the present invention, the recycled wool fibers after being formed into a cloth or fabric are impregnated with an aqueous solution of an acrylic or methacrylic type monomer. The solution preferably contains an acid to promote bonding of the monomer to wool, and a polymerization initiator to promote reaction of the bonded monomers with each other. The treating solution is applied at a temperature below the polymerization initiation temperature. Preferably, also, the solution contains a surfactant promoting contact of the wool fibers with the solution.

After the impregnation, the fabric is washed with water at a temperature below the polymerization initiation temperature to remove the monomer from the chemically inert exterior scaly surfaces of the wool fibers while leaving the monomer chemically bonded with the cortex of the fibers. In a final step, the fabric is cured by heating it at a temperature above the polymerization initiation temperature of the monomer bonded to the cortex.

By the foregoing procedure, it is believed that the resulting polymer is localized in and selectively reacts with the interior protein of the fiber cortex, as exposed in the fissures or breaks in the outer scaly cuticle of the fibers. At the same time, there is relatively little reaction of the monomer with other parts of the fiber. It is believed that the monomers may react with and bond to free hydroxyl and/or amino groups of the interior protein in the areas of the breaks or fissures by reactions such as acylation without substantial free radical graft polymerization or homopolymerization. Washing of the fabric can be carried out while still leaving sufficient monomer and polymerization initiator within the fiber cortex so that a further chemical reaction can occur during the curing step. This curing reaction is visualized as forming cross-links between the previously bonded monomers within the cortex of the fibers. This reaction mechanism may also involve a degree of graft polymerization, whereby short polymer chains are attached to the interior protein of the fibers, as well as the formation of cross-links between monomers or short polymer chains.

THE DRAWINGS

In the accompanying drawings,

FIG. 1 is a diagrammatic flow sheet illustrating how the method of this invention could be carried out in commercial practice; and FIG. 2 is a schematic illustration of the chemical reactions which are believed to be involved in the process steps of this invention.

DETAILED DESCRIPTION

Figure 1:
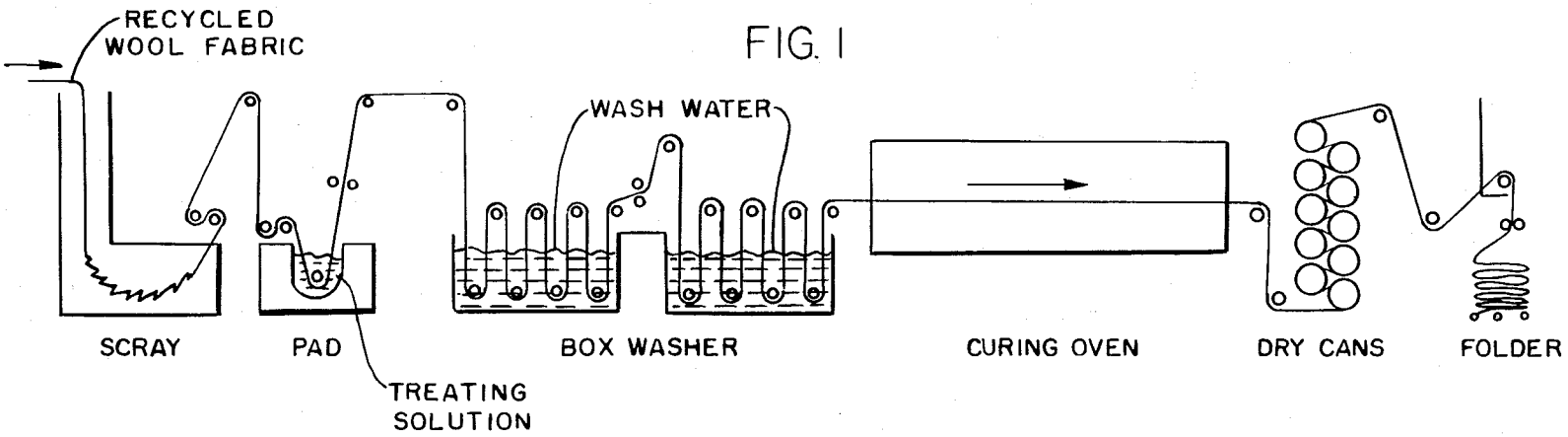

The method of this invention is designed to improve the abrasion resistance of wool fibers which have been previously damaged by prior processing and use.

The accepted generic term for such wool is recycled wool fibers. Recycled wool is distinguished from virgin wool, and includes reprocessed wool, which, for example, may constitute cutting scraps from wool fabric, and also reused wool, which, for example, may comprise shredded clothing. For treatment by the method of this invention, the recycled wool fibers are spun into yarn, and woven into cloth. It is the resulting cloth or fabric which is treated by the method of this invention to increase its abrasion resistance. The fabric may contain other fiber components in addition to the recycled wool fiber, such as virgin wool fibers, synthetic fibers, etc. However, to obtain the important advantages of this invention, the fabric should be composed of at least 50% by weight of recycled wool fiber. In a preferred embodiment, the fabric is composed substantially entirely of recycled wool fiber.

In general, the monomers for use in the method of this invention are bifunctional monomers of low solubility in the solvent used to apply the monomer. Useable monomers are those which are capable of homopolymerization, and, also, more importantly, of graft bonding or graft polymerization with free hydroxyl and/or amino groups of the wool. More specifically, the monomer should contain a vinyl group and also another group that is reactive with hydroxyl or amine groups, viz. by acylation, etc.

Illustrative of the monomers usable in the method of this invention are the acrylic-based and methacrylic-based monomers. The acrylic-type monomers include acrylic acid, acrylic acid chloride, acrylamide, methyl acrylate, ethyl acrylate, and butyl acrylate. The methacrylic-type monomers include methacrylic acid, methacrylamide, methyl methacrylate, ethyl methacrylate, propyl methacrylate, and butyl methacrylate. The reactivity and conditions for reaction of such monomers with wool have previously been described. See, for example, Miller, et al., *Textile Res. J.*, Vol. 31, 451–455 (1961); Varma, et al., *Die Angewandte Makromolekular Chemie*, Vol. 35, 203–211 (1974); Arai, et al., *Int. J. Macromol.*, Vol. 2, 355–360 (1980); Nyak, *J. Macromol. Sci. Rev. Macromol. Chem.*, Vol. C14, 192–213 (1976); and Needles, et al., *Text. Res. J.*, Vol. 42, 558–563 (1972).

A preferred subclass of acrylic-based monomers for use in the method of this invention comprises methyl acrylate and ethyl acrylate. Another preferred subclass of methacrylic-based monomers includes methyl methacrylate and ethyl methacrylate. Other monomers reactive with wool include acrylic acid, acrylamide, glycidyl methacrylate, acryl chloride, acrylonitrile, maleic anhydride, and N-carbamyl maleimide.

In preparing the treating solution used in the method of this invention, the monomer, will usually be in a liquid form, that is, mixed with a liquid solvent. The preferred solvent is water. On a volume basis, the resulting treating solution may contain from 1 to 50% of the monomer, a preferred range being from 2 to 15% monomer. However, the exact concentration is not critical. From the literature, it appears that other usable solvents can include dimethyl formamide, carbon tetrachloride and glacial acetic acid: Miller et al., *Text. Res. J.*, Vol. 31, 451–455 (1961); and Koenig et al., *Text. Res. J.*, Vol. 45, 178–182 (1975).

The pH of the treating solution should be selected to promote the reaction resulting in the monomer being bonded to wool. For example, an acid can be added. The solution may contain by volume from 0.1 to 25.0% acid, a preferred range being from 1.0 to 5.0%. A base may also be used to promote the reaction in certain instances. See, for example, Miller, et al., *Textile Res. J.*, Vol. 31, 451–455 (1961).

The treating solution should also contain a polymerization initiator for the monomer. A preferred initiator is a cerium salt, which in water will provide a ceric ion redox system. In such a system, the ceric ion promotes reaction of the bonded acrylate monomers with each other during the curing step. The cerium salt may be ceric ammonium sulfate. Other usable cerium salts include cerium ammonium nitrate and ceric sulfate.

In addition to the cerium salt initiator, many other chemical systems can be used, which include peroxydisulfate, ferrous ion/hydrogen peroxide, ferric ion/thiourea, copper (II) complexes, dimethylaneline/benzyl chloride, manganese (IV), periodate ion and ozobisisobutyronitrile, etc. Alternatively, initiation may be induced by radiation techniques or can proceed spontaneously in the presence of swelling agents. See Nyak, *Journal of Macromol. Science. Rev. of Macromol. Chem.*, Vol. C14, 193–213 (1976); and Needles, et al., *Textile Res. J.*, Vol. 42, 558–563 (1972).

On a weight percent basis, the concentration of the cerium salt may range from about 0.001 to 10%. When using cerium ammonium sulfate, a preferred range is from about 0.01 to 0.1%. In general, on a cerium ion basis, the concentration of cerium ion can range from about 0.0002 to 2% by weight.

In order to assure adequate penetration of the solution into the wool fibers, particularly in the damaged areas thereof, such as the breaks or fissures in the outer scaly membrane of the fibers, it has been found desirable to incorporate a surface active agent in the aqueous solution. In the method of the present invention, the primary function of the surfactant is to promote the penetration in the wool fibers of the recycled wool fabric by the treating solution. For example, a preferred surface active agent is a nonionic surfactant such as "Triton X-100," Rohm and Haas Co., Philadelphia, Pa. This surfactant may be effectively used at a concentration of from about 0.01 to 10% by weight. Nearly any type of nonionic surfactant can be effectively used at similar concentrations. In addition, other anionic, cationic, or amphoteric surfactants can be used if they do not chemically react with other ingredients of the treating solution.

In practicing the method of this invention, it is preferred to impregnate the recycled wool fabric with the treating solution under conditions where homopolymerization of the monomer is not initiated. In particular, it is preferred to apply the treating solution at a temperature at which polymerization is not initiated. For example, in using methyl acrylate with the chemical system applied in this work, the treating solution may be applied at a temperature of from about 15° to 90° C.

No special technique is required for the impregnation step. The fabric may be immersed in the treating solution, such as being passed through the treating solution in a padder apparatus. Only a very short time of contact is required, such as from about 1 to 10 seconds.

In the next step of the process, the impregnated fabric is washed with water to remove the treating solution from the exterior surfaces of the wool fiber while leaving the solution within the fiber cortex. Further, as will be subsequently described, it appears that some monomer bonding occurs with the hydroxyl and amino groups of the interior protein. To the extent that this bonding occurs during the impregnation and washing steps, the monomer will be selectively retained on the exposed portions of the interior protein.

The washing step is carried out below the polymerization initiation temperature with reference to the vinyl function of the monomer and the initiator present in the treating solution. For example, the washing may be carried out at a temperature of from about 5° to 90° C. for the methyl acrylate-cerium system described herein. This washing step may be carried out very rapidly, such as by passing the fabric through a washing solution with a residence time of about 2 to 500 seconds. A conventional box washer, as used in the textile industry, can be employed for this purpose.

Following the washing step, which is believed to remove most of the acrylate monomer and initiator from the exterior surfaces of the recycled wool fibers while leaving the monomer and initiator within the fibers, especially in the areas of exposed interior protein, the washed fabric is cured by a suitable heat treatment. In general, the fabric should be heated at a temperature above the vinyl polymerization temperature of the acrylate monomer. Some of the bonded monomers may form longer polymer chains, as in ordinary graft polymerization, by reaction with unbonded monomer remaining on the fiber after washing, but this is not believed to be essential to the process. Although the mechanism is not known with certainty, it appears that the acrylate monomers bond to the wool protein by reacting with the hydroxyl and amino groups thereof, and that after bonding, the attached monomers cross-link with each other, and, also, to some extent form longer polymer chains.

The heating required for the curing step may be conveniently applied by microwave radiation. For example, the fabric may be passed through a microwave curing oven. In general, the fabric should be heated to a temperature above the vinyl polymerization initiation temperature of the particular monomer, catalyst and application technique employed. For example, in the case of methyl acrylate, cerium and rapid microwave curing, the fabric temperature should be in the range of about 100° to 200° C. and the residence time in the oven can range from about 2 to 15 minutes to assure completion of the curing. Instead of microwave heating, heat can also be applied in other internal-type heating apparatus, such as hot air or infrared ovens. The curing temperature, curing time and the catalyst chosen may be quite variable, and depend upon the application procedure desired.

The method of this invention and the mechanism and the reaction mechanisms believed to be associated therewith can be more fully understood by reference to the attached drawings. FIG. 1 illustrates the processing of a recycled wool fabric. The fabric is shown as being passed into a scray, and fed therefrom around and over rollers into a pad apparatus. The padder unit contains the treating solution, and is arranged so that the fabric travels through the treating solution for impregnation thereof. The fabric is then passed through a box washer unit which contains the wash water. The box washer unit, as will be understood, will include means for circulation of the wash water therethrough. After completion of the washing contact, the fabric is passed through a curing oven, which may be a microwave oven. It should be understood that the oven will be of such length, or that the fabric will be subjected to multiple passes therethrough, so that the required temperature and time of exposure are provided to complete the curing. After emerging from the curing oven, the fabric can be passed over a drying apparatus, which is known in the textile industry as dry cans. After completion of the drying the fabric is passed to a folder, as shown.

Figure 2:
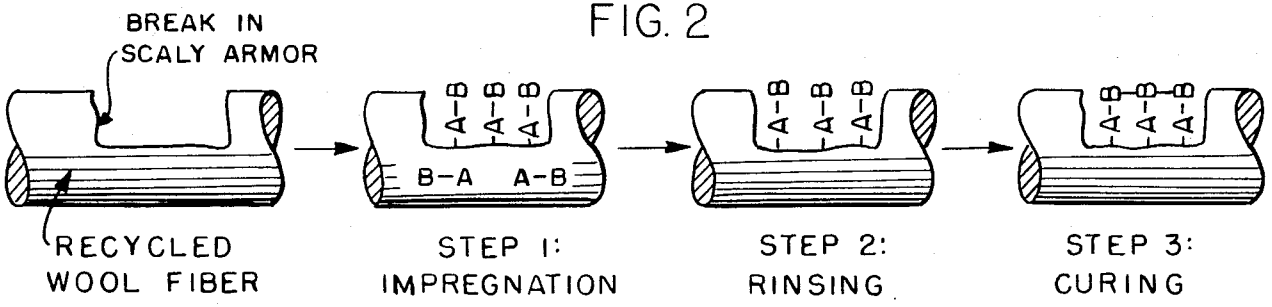

Looking now at FIG. 2, there is shown a segment of a recycled wool fiber, which has a break in the outer scaly cuticle. As illustrated, in the impregnation step, the bifunctional monomer (A-B) is on the exterior surfaces of the fiber, as well as in the area where the interior protein is exposed. As illustrated, it is believed that some of the monomer will rapidly form bonds to the interior protein through the free hydroxyl and/or amino groups. In the washing step, the bonded acrylate monomers remain within the damaged area of the fiber, while being removed from the exterior surfaces. It is to be expected, however, that additional unbonded acrylate monomer will be present together with the initiator within the areas of the exposed interior protein. In the curing step, as visualized in FIG. 2, the primary reaction may be cross-linking between the bonded acrylate monomers. However, it is to be expected that additional graft type bonding may occur, and that some longer chains may be formed.

This invention is further illustrated in preferred embodiment in the following examples.

EXAMPLE I

A woven 100% reused wool fabric which weighed 16 ounces per square yard was padded through a finishing formulation at 50° C. by using two dips and two nips on a three-roll laboratory padder set at a squeeze pressure of 40 psi, to a wet pickup of 80–100%. The pad bath contained the following components:

| | |
|---|---|
| 600 ml | methyl acrylate |
| 5.0 g | ceric ammonium sulfate |
| 40 ml | nonionic wetting agent sold under the trade name Triton X-100 |
| 50 ml | concentrated sulfuric acid |
| 5000 ml | distilled water |

After pad-applying the above solution onto the fabric, the fabric was then rinsed for 30 seconds in water, cured for 5 minutes in a 2450 MHz microwave oven operating at 0.65 kW, and then allowed to dry at room temperature.

Physical testing was performed by standard methods at 21°±1° C. and 65±2% relative humidity. All fabric samples were conditioned for 24 hours prior to testing.

Procedures in ASTM Designation: D3776-79, Standard Test Method for Weight (Mass per Unit Area) of Woven Fabric (Part 32, 1982 Book of ASTM Standards) were used in determining the weight of the wool fabric. Fabric weight was calculated in ounces per square yard, using 5×5 cm specimens. Percentage change in fabric weight after treatment was based on the initial average weight in ounces per square yard of the untreated (grey) wool fabric.

Procedures prescribed in ASTM Designation: D4158-82, Standard Test Method for Abrasion Resistance of Textile Fabrics (Uniform Abrasion Method)-(Part 32, 1982 Book of ASTM Standards) were used in evaluating the abrasion resistance of the wool fabric. Fabric specimens were subjected to 3,000 cycles of abrasion on the Schiefer Abrasion Testing Machine using a spring steel blade abradant and a 3.65 kg load. Abrasion damage was evaluated in terms of percentage weight loss which is the difference in the weight of the specimen before and after testing, expressed as a percent of the original specimen weight.

An air operated King Fabric Stiffness Tester was used to determine the stiffness of the fabric. The pressure in kilograms required to force a folded specimen through the test ring was recorded.

The results were:

| Fabric | Weight Change ($oz/yd^2$) | Abrasion Damage (% weight loss) | Stiffness (kg) |
|---|---|---|---|
| grey | — | 9.2 | 5.1 |
| no monomer | 0.4 | 7.0 | 3.7 |
| with methyl acrylate monomer | 0.5 | 6.0 | 3.6 |

EXAMPLE II

A study was conducted to confirm that the polymerized monomer (methyl acrylate) applied as described in Example I was preferentially concentrated in the exposed areas of the interior cortex. Treated and untreated fibers were stained with a copper agent which had great affinity for the interior cortex, moderate affinity for cuticle, and no affinity for the polymerized methyl acrylate. A scanning electron microscopic x-ray analysis of the copper was then carried out with respect to the exposed cortex and cuticle adjacent to the exposed cortex. A summary of the x-ray analysis is summarized below:

| Fiber Location Examined | Copper Counts Treatment: Without Monomer | With Monomer | Effect of Monomer |
|---|---|---|---|
| interior cortex | 1462 | 1069 | 393 |
| surface cuticle | 412 | 376 | 36 |

Statistical analysis of the above data showed there was no significant difference between the amounts of copper on the surface cuticles of the fibers treated with and without monomer (412 vs. 376). On the other hand, the monomer treatment resulted in a significant decrease in copper in the exposed interior cortex of fibers treated with monomer compared to those treated without monomer (1462 vs. 1069) with a confidence level of 0.025. This indicates that treatment with monomer did not change the surface of the wool fibers, but it did change the areas of the exposed cortex in a significant way.

We claim:

1. The method of improving the abrasion resistance of fabric composed of at least 50% by weight of recycled wool fibers, said recycled fibers containing fissures in their cuticle layers exposing interior protein, comprising:

(a) impregnating the fabric with an aqueous treating solution in the liquid phase including a bifunctional monomer selected from the group consisting of acrylic and methyacrylic type monomers, said monomer containing a vinyl group and a group capable of reacting with the free hydroxyl and/or amine groups of the exposed interior protein of wool fiber, said treating solution containing a polymerization initiator for said monomer and being adapted to promote reaction of the recycled wool with the monomers but being applied to said fabric at a temperature below its polymerization initiation temperature;

(b) washing said fabric with water at a temperature below said polymerization initiation temperature to remove said monomer from the exterior surfaces of the recycled wool fibers while leaving said monomer within said cuticle layer fissures of the recycled fibers; and (c) curing said fabric by heating it at a temperature above the polymerization initiation temperature of said monomer.

2. The method of claim 1 in which said polymerization initiator is a cerium salt.

3. The method of claim 1 in which said monomer is selected from the group consisting of methyl and ethyl acrylate.

4. The method of claim 1 in which said fabric is composed substantially entirely of recycled wool fibers.

5. The method of claim 2 in which said fabric is composed substantially entirely of recycled wool fibers.

6. The method of improving the abrasion resistance of fabric composed of at least 50% by weight of recycled wool fibers, said recycled fibers containing fissures in their cuticle layers exposing interior protein, comprising:

(a) impregnating the fabric with an aqueous solution in the liquid phase of a bifunctional monomer selected from the group consisting of methyl acrylate, ethyl acrylate, methyl methacrylate and ethyl methacrylate, said aqueous solution containing a polymerization initiator and being adapted to promote the reaction of the recycled wool with the monomers and for said monomer together with a surfactant promoting the penetration of the wool fibers of said fabric by said solution, said impregnation being carried out at a temperature of from 15° to 90° C.;

(b) washing said fabric with water at a temperature of from 5° to 90° C. to remove said solution from said exterior surfaces of said recycled wool fibers while leaving said solution within said cuticle layer fissures of the recycled fibers; and (c) curing said fabric by heating it at a temperature of from 100° to 200° C. which initiates polymerization of said monomer.

7. The method of claim 6 in which said monomer is methyl acrylate.

8. The method of claim 6 in which said surfactant is a nonionic surfactant.

9. The method of claim 6 in which said fabric is composed substantially entirely of recycled wool fibers.

* * * * *